United States Patent [19]

Hallam

[11] 4,262,459

[45] Apr. 21, 1981

[54] ROOF GUTTER

[75] Inventor: Dennis M. Hallam, Zillmere, Australia

[73] Assignee: E. Sachs & Co. Ltd., Zillmere, Australia

[21] Appl. No.: 4,525

[22] Filed: Jan. 18, 1979

[30] Foreign Application Priority Data

Jan. 19, 1978 [AU] Australia ..... PD3080

[51] Int. Cl.[3] ..... E04D 13/04; E04D 13/15

[52] U.S. Cl. ..... 52/11; 52/94; 52/95; 52/630; 248/48.2; 405/119

[58] Field of Search ..... 52/11, 12, 15, 16, 94, 52/95, 630; 248/48.1, 48.2; 405/119

[56] References Cited

U.S. PATENT DOCUMENTS

| | | | |
|---|---|---|---|
| 317,841 | 5/1885 | Newton | 52/11 |
| 3,080,682 | 3/1963 | Teutsch | 52/12 |
| 3,913,284 | 10/1975 | Hall | 52/11 |
| 4,128,974 | 12/1978 | Taylor | 52/11 |

FOREIGN PATENT DOCUMENTS

| | | | |
|---|---|---|---|
| 272934 | 2/1967 | Australia | 52/11 |
| 296054 | 4/1967 | Australia | 248/48.2 |
| 485268 | 5/1975 | Australia | 248/48.2 |
| 1370694 | 7/1967 | France | 52/11 |
| 2275608 | 1/1976 | France | 52/94 |

*Primary Examiner*—Alfred C. Perham

*Attorney, Agent, or Firm*—Schwartz, Jeffery, Schwaab, Mack, Blumenthal & Koch

[57] ABSTRACT

A roof gutter of channel shape sheet material, its front flange of greater height than its rear flange, has a series of overflow ports formed in the front flange at a level below that of the top of the rear flange, to prevent water overflowing the rear flange and entering the roof structure, these overflow ports being formed in the bottom part of a continuous longitudinal groove (viewed from the front) formed in the front flange of the gutter, and so the ports are not visible when the gutter is viewed from below.

3 Claims, 3 Drawing Figures

FIG. 2.
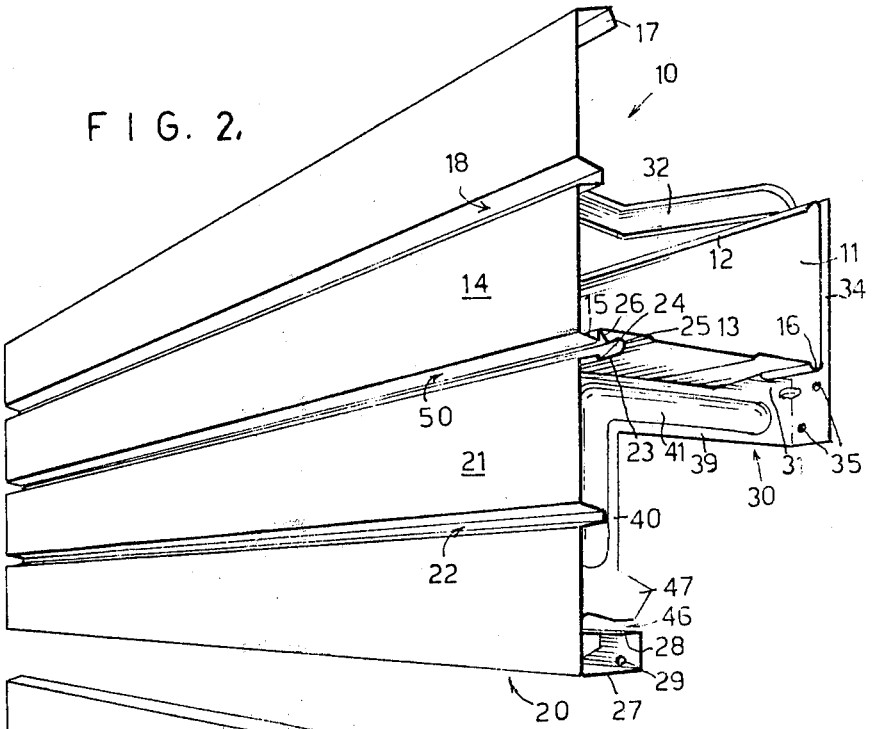
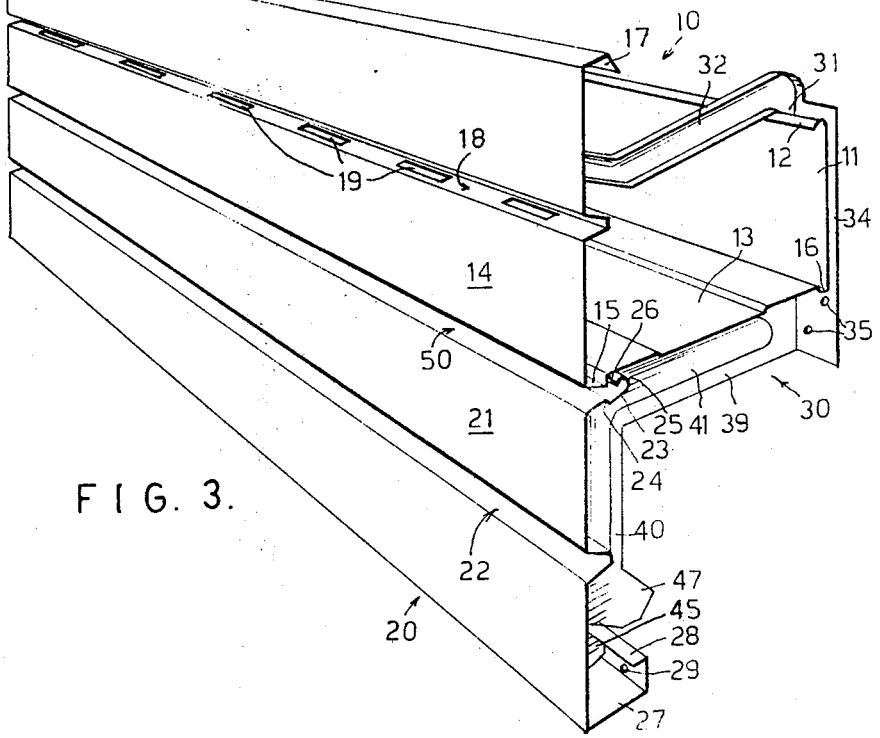
FIG. 3.

ROOF GUTTER

BACKGROUND OF THE INVENTION

This invention relates to a roof gutter.

A gutter installed on a house or other building to receive water from the roof and conduct it to downpipes is commonly of channelled form, and is attached to a fascia board by gutter brackets, the roof tiles or other roofing members projecting over the rear flange of the gutter. To prevent driven rain from entering under the tiles or roofing sheets, and also to conceal the edges of these from view, the front flange of the gutter is normally higher than the rear flange.

Such a gutter has the disadvantage that it may be over-filled during heavy and prolonged rain, or if a down pipe from the gutter should be blocked, with the result that water overflows the rear flange and enters the building structure.

To overcome this disadvantage, it has been proposed to form overflow openings or ports in the front flange of the gutter, below the level of the top of the rear flange, each such opening being formed, for example, by pressing a tongue forwards from the metal below each of a series of longitudinal cuts in the gutter's vertical front flange. These apertures are not apparent when the gutter is viewed from below, but the forwardly extending tongues are clearly visible and detract from the appearance of the gutter. Since the outlet ports are fairly restricted in area, they may, in heavy rainfall conditions, prove inadequate for preventing the gutter from overfilling.

One of the main objects of the present invention is to provide a roof gutter of the general type set out, having formed in its front flange a series of overflow ports which, although they may be of considerable size sufficient to prevent overfill of the gutter in even the most adverse conditions, nevertheless give no indication of their presence when the gutter is viewed from normal line of sight, from below the level of the gutter.

With the foregoing and other objects in view, the invention resides broadly in a roof gutter of the type consisting of a channel with a rear flange, a bottom, and a front flange higher than the rear flange, and with overflow ports in the front flange below the level of the top of the rear flange, wherein the front flange has a continuous longitudinal formation with a surface which is upwardly-facing, viewed from the front, and the overflow ports are located in the said upwardly-facing surface. The longitudinal formation is preferably a groove or recess with rearwardly convergent upper and lower surfaces, and the overflow ports, through the upwardly-facing lower surface, are preferably slotted holes in a longitudinal series. Other features of the invention will become apparent from the following description.

BRIEF DESCRIPTION OF THE DRAWINGS

A preferred embodiment of the invention is shown in the accompanying drawings, wherein:

FIG. 2 is a perspective view of the gutter assembly viewed from a low level, and FIG. 3 is a perspective view of the gutter assembly viewed from above.

DESCRIPTION OF THE PREFERRED EMBODIMENT

Figure 1:
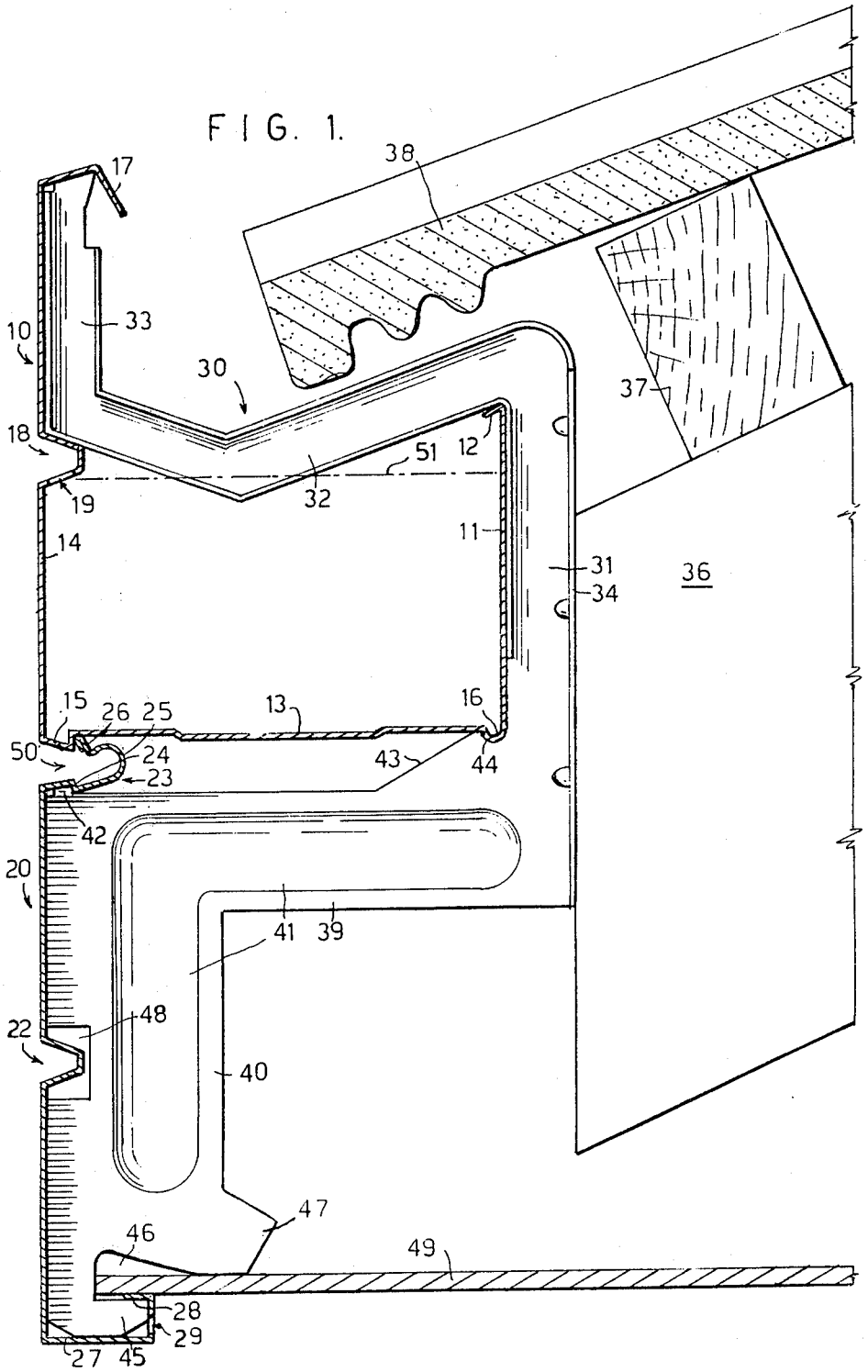
FIG. 1 is a cross-sectional view of a gutter assembly according to the invention, and part of a roof structure to which it is applied.

The assembly illustrated includes a gutter 10 of sheet metal, shaped to form a channel having a rear flange 11 with a top return flange 12, a bottom section 13, and a front flange 14 of considerably greater height than the rear flange.

The bottom section 13 is shaped to form an angular bottom front bead 15 adjacent to the front flange 14, and an arcuately curved bottom rear bead 16 adjacent to the rear flange 11.

The front flange 14 has its upper part bent along parallel lines through two acute angles to form a hooked support flange 17. About midway between its top and bottom, the front flange 14 is formed with a fairly deep continuous longitudinal groove or concavity 18, of which the top and bottom faces are rearwardly convergent. In the bottom face or upwardly-facing surface of this groove 18 there are formed overflow ports 19, being a longitudinal series of equally spaced fairly large slotted holes, which are some distance below the level of the top of the rear flange 11 of the gutter.

The assembly also includes a lower fascia panel 20 of sheet metal having a front face 21 of approximately the same depth as the front flange 14 of the gutter, and with a continuous longitudinal groove or concavity 22 midway between its top and bottom, this groove 22 being of similar profile to the groove 18 of the gutter.

The top of the fascia panel is shaped to form a locking strip 23. From the top of the front face 21, this strip inclines upwardly towards the rear, has a downwardly stepped formation at 24, then continues its upward and rearward inclination for some distance before curving upwardly and forwardly at 25, terminating in an upwardly and forwardly inclined flashing strip 26.

The bottom of the fascia channel is shaped to form a rearwardly extending bottom channel 27, the rear flange of which is bent forward at the top to constitute a soffit support flange 28. At intervals, small drainage holes 29 are formed in the rear flange of the bottom channel 27.

Both the gutter 10 and the fascia panel 20 are fixed on a series of mounting brackets 30 of pressed sheet metal. Each bracket has an upright back piece 31 from the top of which an upper arm 32 extends forwardly, inclining downwardly for some distance and then inclining upwardly towards its front, from which there extends an integral top front upright 33. To impart rigidity, the upper arm 32 and most of the top front upright 33 and of the back piece 31 are pressed to channel form, the rear flange of the channelled back piece 31 being extended to constitute an attachment plate 34 with nail holes 35 (some of which are shown in FIGS. 2 and 3) to enable the bracket 30 to be nailed to the vertical end of a rafter 36 of a roof structure, which does not include any fascia board. Battens 37 nailed onto the rafters 36 support roofing tiles 38.

From the bottom of the back piece 31 of each bracket 30 a lower arm 39 extends forwardly, a bottom front upright 40 extending downwardly from its front end, an angled reinforcing rib 41 being pressed from the lower arm and bottom front upright to impart rigidity.

The top of the lower arm 39 has, at the front, an upwardly extending retaining lug 42, and towards the back, an upwardly inclining ramp 43 leading to a downwardly extending notch 44 next to the back piece 31 of the bracket.

The bottom front upright 40 has a rearwardly extending bottom lug 45, above which is a notch or recess 46, and above this recess is a rearwardly projection 47. A notch 48 is formed from the middle of the front of the bottom front upright 40.

The fascia panel is fitted by engaging its bottom channel 27 and flange 28 with the bottom lugs 45 of the brackets, and pressing the fascia panel back so the step 24 of locking strip 23 snaps into engagement with the bracket retaining lug 42. Next the gutter is installed, hooking its support flange 17 on the front uprights 33 and pressing it back so its bottom rear bead 16 rides up the ramps 43 of the brackets and into the notches 44, the fascia panel flashing strip 26 then bearing against the gutter's bottom front bead 15 to exclude moisture from the junction of gutter and fascia panel. The gutter cannot lift as its return flange 12 and recessed part 18 are then located close under the upper arms 32 of the brackets.

A soffit 49 of sheet material is supported at its front on the soffit support flange 28 of the fascia panel, and is held down by the projections 47 of the brackets 30.

The gutter's bottom front bead 15 and the fascia panel's locking strip 23 define a continuous longitudinal recess 50 which, when the gutter is viewed from below, is of similar appearance to, and midway between, the longitudinal grooves or recesses 18 and 22 of the gutter and fascia panel. The co-planar gutter front flange 14 and fascia panel front face 21 have the appearance of an integral fairly deep fascia with three equally spaced and similar horizontal grooves, the overflow ports 19 in the upwardly-facing bottom surface of the top groove 18 not being visible from normal viewpoint. However, if the gutter 10 should become filled to the level indicated at 51 in FIG. 1, water will escape through the overflow ports and will not overflow the back flange 11 of the gutter, the top of which is at a considerably higher level. The junction of the gutter and the fascia panel is such that there will be very little likelihood of driven rain entering, but any moisture which may enter, or form by condensation, behind the fascia panel will be received in the bottom channel 27 and escape through the drainage holes 29.

The assembly may be installed quickly and easily and without any high degree of skill being required. The elimination of the customary fascia board will result in considerable economies in the construction of the building.

I claim:

1. A channel-shaped roof gutter having substantially vertical front and back flanges, and a bottom wall interconnecting said flanges, said front flange including a hooked support flange at its upper end, a single longitudinal groove formed in said front flange approximately intermediate the height thereof, said groove having rearwardly convergent top and bottom faces, said bottom face being below the top of the back flange of said gutter and having overflow ports formed therein, said front flange comprising coplanar portions above and below said longitudinal groove, a locking bead formed at the juncture of said back flange and said bottom wall and extending downwardly from said bottom wall, a top return flange formed at the upper end of said back flange, and a downwardly extending bead formed at the juncture of the lower coplanar portion of said front flange and said bottom wall.

2. A fascia panel for a roof gutter assembly, comprising a front wall defined by upper and lower coplanar wall portions, a longitudinal inwardly offset groove formed between said upper and lower wall portions, a locking strip at the top end of said upper wall portion by means of which said fascia panel is adapted to releasably engage a roof gutter, said locking strip including an inwardly and then downwardly extending stepped formation, a generally U-shaped intermediate portion which extends first rearwardly and then forwardly, and a terminal flashing strip at the upper end of said intermediate portion, said flashing strip being rearwardly offset from said coplanar wall portions, and a rearwardly extending bottom channel formed at the bottom of said lower wall portion, said channel including a rearwardly extending bottom flange portion, a vertically upturned flange portion, and a forwardly directed flange consequently spaced from and extending parallel to said bottom flange portion, said channel being adapted to extend around supporting means for supporting said fascia panel on a roof assembly.

3. The fascia panel of claim 2, wherein said vertically upturned flange portion of said channel is formed with longitudinally spaced drainage holes by means of which moisture accumulating at the bottom of said fascia panel can be drained therefrom.

* * * * *